United States Patent [19]

Ohtawa et al.

[11] 4,398,876

[45] Aug. 16, 1983

[54] HOT-BRIQUETTING APPARATUS FOR REDUCED IRON

[75] Inventors: Kimiaki Ohtawa; Hiroyoshi Takahashi; Yasuo Fukada, all of Hiroshima, Japan

[73] Assignee: Mitsubishi Jukogyo Kabushiki Kaisha, Tokyo, Japan

[21] Appl. No.: 253,142

[22] Filed: Apr. 10, 1981

[30] Foreign Application Priority Data

Apr. 24, 1980 [JP] Japan ..... 55-53594

[51] Int. Cl.[3] ..... B28B 17/00

[52] U.S. Cl. ..... 425/143; 425/144

[58] Field of Search ..... 425/143, 144

[56] References Cited

U.S. PATENT DOCUMENTS 3,366,717 1/1968 Rohaus ..... 425/237
3,450,529 6/1969 MacDonald ..... 425/237
3,833,327 9/1974 Pitzer et al. ..... 425/237
3,932,169 1/1976 Anthony, Jr. ..... 425/237

*Primary Examiner*—James R. Hall
*Attorney, Agent, or Firm*—Wenderoth, Lind & Ponack

[57] ABSTRACT

The present invention relates to a hot briquetting apparatus for producing reduced iron briquettes comprising a container for receiving high temperature reduced iron; a storage tank connected to and located underneath the container for storing reduced iron and a hot briquetting machine located at a bottom opening of the storage tank. The improvement involves a means for charging residual reduced iron powder, carbon or mixtures thereof as well as an inert gas into the storage tank, said charge means connected to the storage tank and penetrating into the storage tank so that it is attached in a fluid-tight manner; said powder, carbon, inert gas, etc., being funneled into the storage tank in specific proportions in response to control means which are activated by a temperature sensor in contact with the reduced iron within the storage tank.

3 Claims, 6 Drawing Figures

FIG. 3(A)
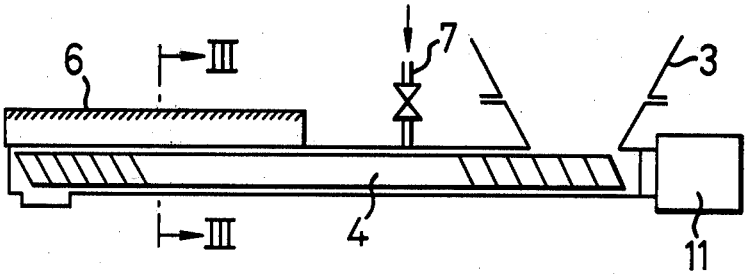
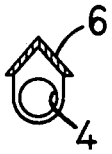
FIG. 3(B)
FIG. 4(A)
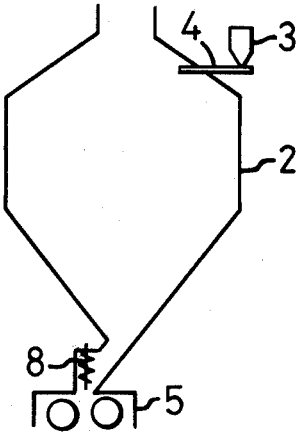
FIG. 4(B)
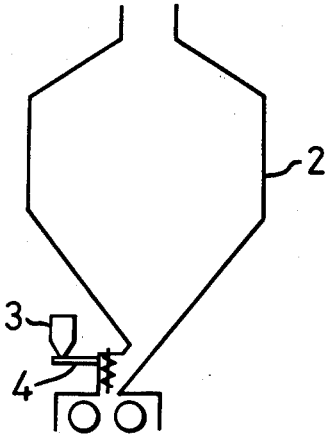

HOT-BRIQUETTING APPARATUS FOR REDUCED IRON

The present invention relates to an improved apparatus for reduced iron particulates.

The so-called hot briquettes formed by shaping reduced iron particulates at a high temperature have decided merits in that they are barely reoxidized, the pulverizing rate during their handling is small, they have favorable specific gravities, and so on.

A heretofore known hot-briquetting apparatus for producing reduced hot briquettes from reduced iron is normally constructed as shown in FIG. 1. More particularly, high-temperature reduced iron conveyed by a container 1 from a reduced iron production apparatus, not shown, is introduced into a storage tank 2, then charged into a gap between the rolls of a briquetting machine 5 consisting of a pair of rolls via a screw feeder associated with a drive source (means for forcibly feeding reduced iron) 8 provided at the bottom opening portion of a storage tank 2, where the reduced iron is compressed and shaped between the rolls into hot briquettes. These hot briquettes form a continuous belt-like state at this time point with the individual hot briquettes connected together with ribs. This belt-like connection of briquettes is separated into individual hot briquettes by means of a divider d, and thereafter discharged externally through a water-cooled feeder f. This water-cooled feeder f is filled with circulating water. Since the reduced iron powder produced when the belt-like connection is separated into the individual hot briquettes by the divider d as described above is discharged as contained in the water circulated through the water-cooled feeder f, the yield of hot briquettes is low in the prior art method. Further, no consideration is made on the practical recovery and reuse of the discharged reduced iron powder.

On the other hand, when the reduced iron is molten in an electric furnace, it is necessary that an appropriate amount of carbon (C) is in the form of iron compounds in the reduced iron. However, in order for the carbon to be separated and deposited on the reduced iron within a reduced iron production apparatus, it becomes necessary to consume carbon monoxide (CO) which is present in the reduction gas produced from an expensive natural gas, and hence, it is more economical to produce a solid carbon deposit on the reduced iron outside of the reduced iron production apparatus. Although it is very difficult to uniformly deposit carbon on the reduced iron, outside of the reduced iron production apparatus as mentioned above, it has been believed to be relatively possible to charge carbon within a hot briquette. However, so far, no apparatus having practical means for charging carbon within a hot briquette has been proposed.

It is therefore an object of the present invention to provide a novel hot-briquetting apparatus for improving the yield of hot briquettes made of reduced iron.

Another object of the present invention is to provide a novel hot-briquetting apparatus for producing briquettes from reduced iron in which carbon can be charged within the individual briquettes.

In order to achieve the aforementioned objects, according to the present invention, a reduced iron powder produced in the hot-briquetting process and/or carbon to be charged within the respective reduced iron briquettes are simultaneously and controllably fed to a hot-briquetting apparatus.

According to one feature of the present invention, there is provided a hot-briquetting apparatus for producing reduced iron briquettes, including a storage tank for receiving and storing high-temperature reduced iron from a container which conveys the reduced iron discharged from a reduced iron production apparatus, a briquetting machine disposed at the bottom opening portion of said storage tank, and means disposed in the lower portion of said storage tank for forcibly feeding high-temperature reduced iron into said briquetting machine. The invention is characterized in that said hot-briquetting apparatus comprises a hopper for receiving and storing reduced iron powder produced upon hot-briquetting by said briquetting machine and/or carbon, and means for charging the reduced iron and/or carbon into the storage tank, which charging means includes means for introducing an inert gas. The charging means is driven by a drive motor whose rotation is controlled by a control device adapted to be actuated by means for detecting the temperature of the reduced iron disposed in said storage tank, and which means has one end which penetrates in a fluid tight arrangement through the walls of the storage tank.

The above-mentioned and other features and objects of the present invention will become more apparent by reference to the following description of the preferred embodiments of the invention taken in conjunction with the accompanying drawings, wherein:

FIGS. 2, 3A and 3B illustrate one preferred embodiment of the present invention, FIG. 2 being an overall system diagram, FIG. 3A being a schematic longitudinal cross-section view of a screw feeder, and FIG. 3B being a schematic transverse cross-section view of the same; and FIGS. 4A and 4B, respectively, are schematic views showing other preferred embodiments of the present invention.

Now the present invention will be described in greater detail in connection with one preferred embodiment thereof illustrated in FIGS. 2, 3A and 3B.

Figure 1:
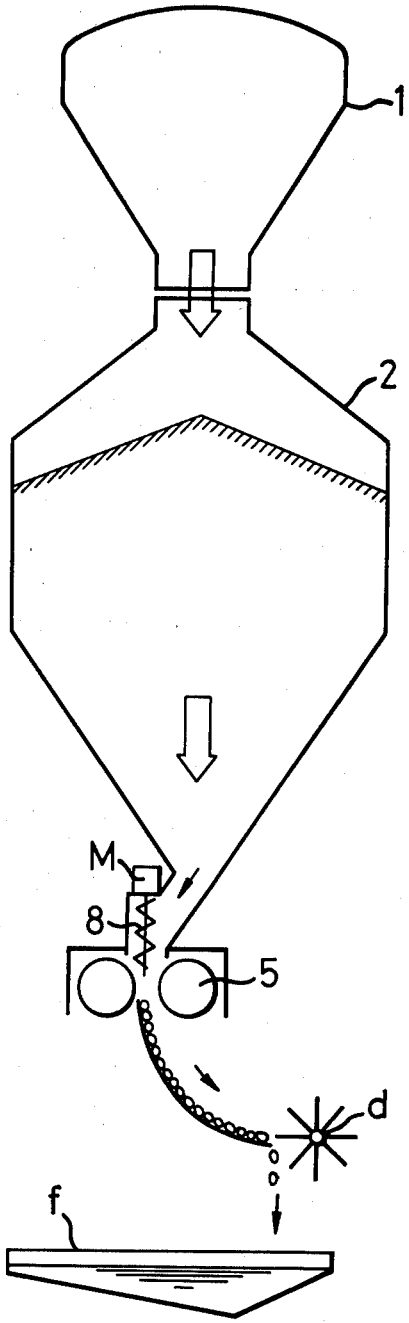
FIG. 1 is a schematic view showing a hot-briquetting apparatus for producing briquettes from reduced iron according to the the prior art.
Figure 2:
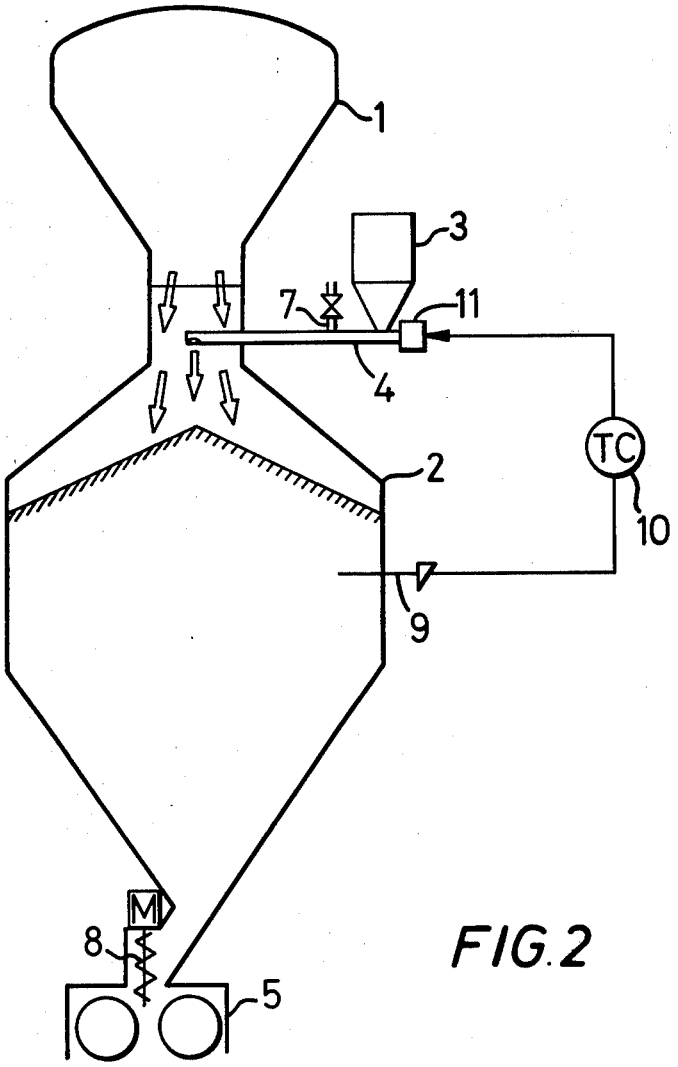

With reference to FIG. 2, reference numeral 1 designates a container for receiving high-temperature reduced iron discharged from a reduced iron production apparatus not shown, which container conveys the reduced iron to a hot briquetting apparatus. Numeral 2 designates a storage tank for receiving the high-temperature reduced iron from the container 1 and storing the same; numeral 5 designates a briquetting machine, and numeral 8 designates means for forcibly feeding reduced iron to the briquetting machine 5 such as, for instance, a screw feeder.

The constructions and operations of the above members and the mutually correlating members are substantially identical to those of the above-described hot-briquetting apparatus in the prior art (Equivalent component parts are given like the reference numerals.).

Reference numeral 4 of said FIG. 2 designates means for charging the reduced iron powder and/or carbon into the storage tank 2 such as, for example, a screw feeder, which has one end portion fluid-tightly inserted to an appropriate position in the top portion of the storage tank 2 in the proximity of the joint between the container 1 and the storage tank 2; a hopper 3 for feeding reduced iron powder and/or carbon to the screw feeder 4 is mounted at an appropriate position in the other end portion of the screw feeder 4. Reduced iron powder produced upon hot-briquetting by the aforementioned briquetting machine 5 is recovered and fed to the hopper 3 through a piping not shown, and also provision is made such that carbon may be appropriately fed to the hopper 3 through another piping not shown.

Reference numeral 6 of FIGS. 2, 3A and 3B designates a wear preventing liner mounted above a portion of the screw feeder 4 of FIG. 2 inserted into the storage tank 2 along its longitudinal direction, and this liner 6 is useful for preventing wear of the screw feeder 4 caused by high-temperature reduced iron falling from the container 1 into the storage tank 2. Reference numeral 7 designates means for introducing an inert gas such as, for example, a blast tube, which means is mounted to the screw feeder 4 in the proximity of the mounting portion of the hopper 3 to the screw feeder 4 and has an opening/closing valve interposed therein, and by always blasting an inert gas such as a nitrogen ($N_2$) gas, an inert element gas, etc. through the blast tube 7 into the screw feeder 4, air is prevented from entering through the hopper 3 as mixed with the reduced iron and/or carbon, so that entrance of air into the storage tank 2 can be prevented to control reoxidation of the high-temperature reduced iron in the storage tank 2. Reference numeral 9 designates means for detecting the temperature of the reduced iron within the storage tank 2 (a temperature detector), numeral 10 designates a controller (a control device) that is operable in response to a detection signal from the temperature detector 9, and provision is made such that rotation of a drive motor 11 for the screw feeder 4 can be controlled by the controller 10.

One preferred embodiment of the present invention is set forth as in FIG. 2 as described above, and when the high-temperature reduced iron contained in the container 1 is transferred into the storage tank 2 from the container 1 by opening a valve (not shown) incorporated in the container, the drive motor 11 is actuated simultaneously to drive the screw feeder 4. Then, the reduced iron powder (reduced iron powder recovered from the briquetting machine) and carbon within the hopper are fed into the storage tank 2, and mixed with the high-temperature reduced iron thrown from the container 1 into the storage tank 2. In this case, owing to the inert gas continuously blasted into the screw feeder 4 through the inert gas blast tube 7, the mixing of air fed through the hopper 3 can be prevented, and accordingly there is no fear that air may enter into the storage tank 2 reoxidizing the high-temperature reduced iron. Moreover, thanks to the wear preventing liner 6, the screw feeder 4 would be never worn by the high-temperature reduced iron transferred from the container 1.

In addition, the temperature detector 9 disposed within the storage tank 2 detects the temperature of the high-temperature reduced iron within the storage tank 2, and the rotation of the drive motor 11 is controllably adjusted by the controller 10 which operates in response to the detection signal from the detector 9. This combined operation is designed to appropriately adjust the mixing rate of the reduced iron powder and/or carbon within the hopper 3 into the storage tank 2 via the screw feeder 4, and thereby the mixing of the reduced iron powder and carbon with the high-temperature reduced iron can be achieved within the storage tank in appropriate proportions.

While the reduced iron powder and carbon are charged into the storage tank 2 at an appropriate mixing proportion by the charging means of one system consisting of the members 3, 4, 6, 7, 9, 10, 11, etc. in the preferred embodiment described above and illustrated in FIGS. 2, 3A and 3B, the reduced iron powder and carbon could be charged into the storage tank 2 by charging means of two separate systems.

Since the apparatus according to the present invention has the above-mentioned apparatus and operations, it has the following practical advantages:

(1) Improvements in the yield of reduced iron briquettes can be achieved, because the reduced iron powder produced in the briquetting machine is recovered, then it is returned into the storage tank 2, and again it is shaped into hot briquettes.

(2) Carbon-containing hot briquettes of low cost can be easily produced, because carbon is mixed directly with the high-temperature reduced iron within the storage tank 2.

(3) Hot briquettes having stable qualities can be obtained, because even in the case where some differences in temperatures of the high-temperature reduced iron exists between the individual containers 1, the reduced iron powder can be fed into a storage tank 2 as adjusted to maintain the temperature of the reduced iron within the storage tank 2 at a constant temperature by controlling the charging system of the reduced iron powder.

Modified embodiments illustrated in FIGS. 4A and 4B, respectively, are different from the above-described first preferred embodiment of the present invention in that the charging system for the reduced iron powder and carbon including a the hopper 3 and the screw feeder 4 (the other members being omitted from illustration) are disposed at the respective illustrated positions relative to the storage tank 2 as will be seen from these figures, but they achieve the same functions and effects as the embodiment shown in FIGS. 2, 3A and 3B. However, it is to be noted that in the modified embodiments, in view of the location of the charging system the wear preventing liner 6 for the screw feeder 4 is unnecessary.

Since many changes could be made in the above construction; many widely different embodiments of this invention could be made without departing the scope thereof. It is the intention that the subject matter of the present invention as set forth above and shown in the accompanying drawings should be interpreted as illustrative and not as a limitation of the scope of the invention.

What is claimed is:

1. In a hot-briquetting apparatus for producing reduced iron briquettes which comprises a container for receiving high temperature reduced iron; a storage tank connected to said container with an opening at the upper end to receive said reduced iron from said container and which storage tank has an opening at the lower end thereof; a briquetting machine located at the bottom opening of said storage tank and means located at a lower portion of said storage tank for forcibly feeding the reduced iron into the briquetting machine; the improvement which comprises charging means connected to the storage tank below said upper opening for introducing (1) residual high temperature reduced iron produced from the briquetting of the reduced iron with the briquetting machine; (2) carbon or (3) mixtures of said residual reduced iron produced from the briquetting machine and carbon; and which charging means includes means for introducing an inert gas into said charging means, and a hopper, connected to said charging means, for receiving the iron produced from the briquetting machine; carbon or mixtures of said reduced iron or carbon as set forth in (1), (2) or (3) above; said charging means being driven by a drive motor whose rotation is controlled by a control means, said control means being activated by means for detecting the temperature of the reduced iron, said temperature detecting means being located in said storage tank; wherein said charging means connected to said storage tank penetrates through a wall of the storage tank so that the connection between the charging means and the storage tank is fluid tight.

2. An apparatus according to claim 1, wherein the charging means is a screw feeder.

3. An apparatus according to claim 1 wherein the charging means contains an opening for introducing the inert gas located next to the hopper.

* * * * *